US005669299A

United States Patent [19]

Ando et al.

[11] Patent Number: 5,669,299

[45] Date of Patent: Sep. 23, 1997

[54] METHOD FOR PREPARING A THERMOSENSITIVE STENCIL WITH A THERMAL LABEL PRINTER

[75] Inventors: Yoichi Ando, Sagamihara; Koichi Hirano, Yokohama, both of Japan

[73] Assignee: Mitsubishi Pencil Kabushiki Kaisha, Tokyo, Japan

[21] Appl. No.: 698,753

[22] Filed: Aug. 16, 1996

Related U.S. Application Data

[60] Continuation of Ser. No. 433,242, May 2, 1995, abandoned, which is a division of Ser. No. 341,005, Nov. 17, 1994, abandoned.

[30] Foreign Application Priority Data

Dec. 3, 1993 [JP] Japan ..... 5-304383

[51] Int. Cl.[6] ..... B41L 13/00

[52] U.S. Cl. ..... 101/128.4; 101/125

[58] Field of Search ..... 101/114, 125, 101/128.21, 128.4, 477

[56] References Cited

U.S. PATENT DOCUMENTS 5,184,549 2/1993 Imamaki et al. ..... 101/121

5,251,567 10/1993 Fuwa ..... 101/128.4

5,253,581 10/1993 Miki et al. ..... 101/125

5,329,848 7/1994 Yasui et al. ..... 101/125

5,491,503 2/1996 Fuwa ..... 101/128.4

FOREIGN PATENT DOCUMENTS 347681 12/1992 Japan ..... 101/128.4

*Primary Examiner*—Stephen R. Funk

*Attorney, Agent, or Firm*—Darby & Darby

[57] ABSTRACT

A cartridge containing a thermosensitive stencil original comprising a tape-formed thermosensitive stencil original which is to be perforated to create a print image, a pressing member for pressing the thermosensitive stencil original, and a cassette case having the pressing member disposed therein. The thermosensitive stencil original is also accommodated inside the cassette case so that the stencil original may be carried out from the cartridge. The mirror image of the desired print image is perforated onto the surface of the thermosensitive stencil original.

5 Claims, 3 Drawing Sheets

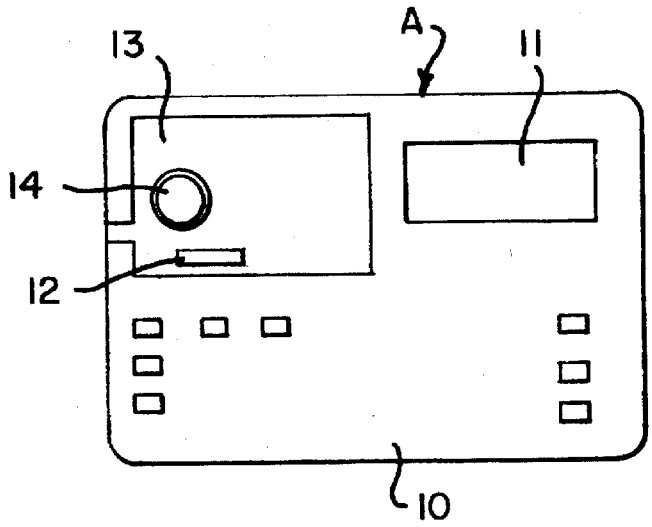
FIG. 1A
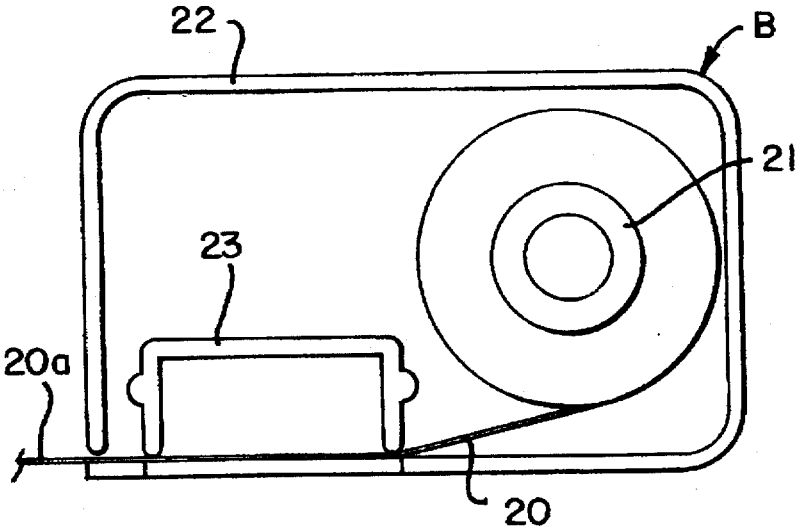
FIG. 1B
FIG. 2A
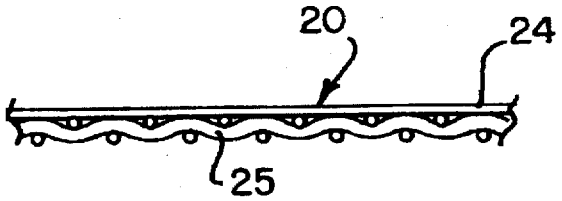
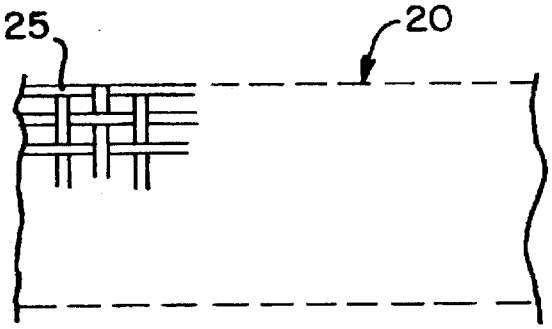
FIG. 2B

METHOD FOR PREPARING A THERMOSENSITIVE STENCIL WITH A THERMAL LABEL PRINTER

This is a continuation of application Ser. No. 08/433,242, filed May 2, 1995, now abandoned, which, in turn, was a division of application Ser. No. 08/341,005, filed Nov. 17, 1994, now abandoned.

BACKGROUND OF THE INVENTION

1. Field of the Invention

The present invention relates to a method for preparing a thermosensitive stencil and further relates to a cartridge containing a wound thermosensitive stencil original which can be carried out from the cartridge.

2. Description of the Related Art

A thermosensitive stencil is typically prepared by placing a sheet-formed thermosensitive stencil original on top of a manuscript which has an image comprising patterns and characters formed in positions to be perforated with a carbon containing ink or the like. The thus layered sheets are then exposed from the top to light emissions from, for example, a flash lamp, so that the thermosensitive stencil original becomes fused and perforated in the aforementioned image portion.

The resulting state of a thermosensitive stencil having been perforated by fusing the above-mentioned stencil original, however, depends largely upon the state of the manuscript. Therefore, much skill is required to create satisfactory results.

Alternatively, a PPC copier may be used to reduce the variation in the outcome. However, one disadvantage of this method is that it reduces the image sharpness and creates, for example, dirty spots on the manuscript.

Alternatively, in order to eliminate the above-mentioned drawbacks, an image laid out on a screen of a word processor can be directly printed onto a thermosensitive stencil original sheet by means of a typical thermal head printer. This thermal head printer is built into the word processor so that the stencil original sheet may be perforated by the thermal head. The thermosensitive stencil original sheet is set on the word processor in place of a word processor paper sheet. However, this method also has several constraints upon its use by virtue of the fact that this stencil original sheet is not particularly adapted for use in word processors. For example: (1) it is difficult to set the stencil original sheet on the printer; (2) the print layout requires skilled techniques; and (3) the stencil original sheet must be large enough to be handled and conveyed by the sheet feeder of the word processor, even when much smaller print images are desired.

Another application of thermosensitive stencils is with label word processors for preparing label stickers. Typically, a label word processor includes an input keyboard and a display portion composed of, for example, a liquid crystal display device. This label word processor can be used to print data generated based on the built-in font in accordance with commands inputted by means of the keyboard or data obtained via external input means. Such print data is generated onto a label tape using heat generated by a thermal head.

Referring to FIG. 6, a label tape cartridge 1 used in the prior art label word processor (described above) comprises a label tape 3 wound on a core member 2; a thermal transfer ink ribbon 6 wound on a supplying core member 4; a wind-up core member 5 to collect the thermal transfer ink ribbon 6; a pressing member 7; and a cassette case 8 accommodating all of the above-recited elements. As shown in FIG. 7, the label tape 3 is composed of a tape base 3*a*, an adhesive layer 3*b* coated on the rear side of the tape base 3*a*, and a protecting tape layer 3*c* laminated over the adhesive layer 3*b*.

In this label word processor, an operator inputs data, such as characters etc., through the keyboard and confirms the printing content on the display portion of, for example, a liquid crystal display device. The inputted data may then be printed, as shown in FIGS. 6 and 7, by transferring a thermal transfer ink layer 9 onto the tape base 3*a* with the help of a thermal head (not shown), thus forming a marked label tape. As the ink ribbon 6 is fused, the inputted data is transferred onto the label tape 3, and the label tape 3 is pulled out. The label tape 3 is then cut to a desired length by a cutter (not shown). Then, the protecting paper layer 3*c* is peeled off so that the printed tape label can be stuck on an article to be labeled. It is also possible to use a tape base having a thermosensitive layer which allows characters etc. to be printed directly by the thermal head without using ink ribbons. Using a label word processor for preparing tape labels generally makes it possible to determine automatically the length of the tape based on the tape width and the input data. Also, the character size and character space can be set automatically by specifying the desired tape length. Therefore, with relatively simple handling, the device can provide well-finished tape labels.

Nevertheless, since the labels prepared by the label word processor of this kind are themselves of a specific thickness, the tape itself can sometimes become a hindrance, or else, the characters on the labels may not match those printed on a document. Further, since the label tape is typically made from PET film etc., this material is difficult to write on using normal writing implements.

SUMMARY OF THE INVENTION

In view of the aforementioned problems in preparing thermosensitive stencils, the present invention is directed to preparing labels by means of a label word processor. It is an object of the present invention to provide a method for preparing a thermosensitive stencil whereby a well-finished thermosensitive stencil can be obtained in a simple manner using a label word processor which contains a thermal printer that is capable of tape-printing. Further, it is another object of the present invention to provide a cartridge containing a thermosensitive stencil original which is used to realize the aforementioned method.

A first aspect of the present invention discloses a method for preparing a thermosensitive stencil comprising the steps of loading a cartridge containing a tape-formed thermosensitive stencil original into the cartridge compartment of a thermal printer having a thermal head which allows tape printing; perforating the thermosensitive stencil original to create a print image by means of the thermal head; and cutting a resulting thermosensitive stencil carried out from the cartridge to a desired length. The cartridge contains a cassette case in which the thermosensitive stencil original is accommodated, so that the thermosensitive stencil original may be carried out from the cartridge.

A second aspect of the present invention discloses a cartridge containing a thermosensitive stencil original comprising a tape-formed thermosensitive stencil original which is to be perforated to create a print image; a pressing member for pressing the thermosensitive stencil original; and a cassette case having the pressing member disposed therein and having the thermosensitive stencil original accommodated therein, so that the stencil original is carried out from the cartridge.

BRIEF DESCRIPTION OF THE DRAWINGS

The foregoing and other features of the present invention will be more readily apparent from the following detailed description and drawings of illustrative embodiments of the invention in which:

FIG. 1A is a schematic plan view showing a thermal printer for use in a method of the present invention;

FIG. 1B is a schematic plan view showing an embodiment of a cartridge containing a thermosensitive stencil original used in the method of the present invention;

FIG. 2A is a sectional view showing a preferred embodiment of the thermosensitive stencil original according to the present invention;

FIG. 2B is a bottom view thereof;

DESCRIPTION OF THE PREFERRED EMBODIMENTS

Figure 3:
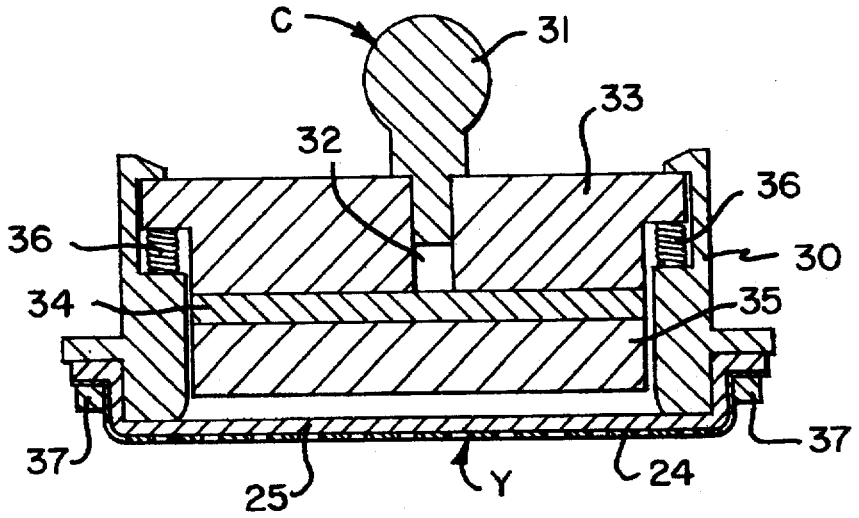
FIG. 3 is a sectional view showing the thermosensitive stencil according to the present invention, as mounted onto a stamping device.

This invention discloses a method for preparing a thermosensitive stencil by using a specific thermosensitive stencil original and an existing thermal printer capable of tape-printing. The present invention also discloses a cartridge which is able to accommodate the thermosensitive stencil.

In accordance with the present invention, a cartridge having a rolled, tape-formed thermosensitive stencil original accommodated in a cassette case so that the thermosensitive stencil original can be carried out therefrom, is loaded onto a cartridge compartment of a thermal printer while a print image is formed on the thermosensitive stencil original. The print image may be composed of characters, patterns, symbols and/or marks (hereinafter referred to as "input characters"). The print image is formed using input means on the thermal printer or by external input means. The thermosensitive stencil original is carried out from the aforementioned cartridge so that the thermosensitive stencil original can be perforated to prepare a thermosensitive stencil. The resulting thermosensitive stencil is then cut to a desired length. Thus, it is possible to prepare a thermosensitive stencil in a similar manner to that used for preparing ordinary tape labels. It is also possible to easily effect stencil perforation in only required positions.

The cartridge of the present invention can be handled in the same manner as one constructed for handling a cartridge for preparing ordinary tape labels. This is because the cartridge containing a thermosensitive stencil original is constructed so that the cartridge can be loaded onto a cartridge compartment of a thermal printer having a thermal head capable of tape-printing.

A method for preparing a thermosensitive stencil according to the present invention, and an embodiment of a cartridge containing a thermosensitive stencil original for use in the method, will be described in detail with reference to FIGS. 1 to 5.

Referring to FIG. 1A, a thermal printer A typically includes an input keyboard 10 and/or a selecting dial means, a display portion 11 of, for example, a liquid crystal display device, a thermal head 12, a cartridge compartment 13, and a feed roller 14. In the thermal printer A, heat from the thermal head 12 is used to print or perforate a print image inputted at the keyboard 10. This print image is set up by using the selecting dial means or some other external input means. A label word processor having an existing thermal printer function is preferably employed.

Referring to FIG. 1B, a cartridge B containing a tape-formed thermosensitive stencil original 20, as described above, is rolled up on a core member 21 accommodated in a cassette case 22 so that the thermosensitive stencil original 20 can be carried out from the cassette case 22. Preferably, this cartridge B is identical in shape and features to the label tape cartridges used in a label word processor having a conventional thermal printer. In FIG. 1B, reference numeral 23 designates a pressing member. Alternatively, the thermosensitive stencil original 20 may be wound up into a roll without the core member 21 and accommodated in the cassette case 22 so as to be carried out therefrom. Thus configured, the cartridge B can be mounted in the cartridge compartment 13 of the thermal printer A used in the method of the present invention.

As shown in FIGS. 2A and 2B, the thermosensitive stencil original 20 is preferably composed of a stretched thermoplastic resin film 24 of about 3 to 15 μm thick. The thermoplastic resin film 24 is laminated on a porous supporting sheet 25 having a basis weight of 7 to 15 g/m$^2$. The porous supporting sheet 25 is (1) permeable to ink, and (2) relatively heat resistant. Examples of the thermoplastic resin film 24 include a vinylidene chloride-vinyl chloride copolymer resin film, a polypropylene resin film, etc. Examples of the main component of the porous supporting sheet 25 include: screens made up of natural fibers such as silk, cotton, Manila hemp, etc.; screens made up of organic fibers such as vinylon, nylon, polyester, rayon etc.; and inorganic fibers such as metals, glass fibers, etc.

Preferably, the thermosensitive stencil original 20 can be prepared by adhering a vinylidene chloride-vinyl chloride copolymer film stretched to a thickness of approximately 7 μm, onto a polyester fiber-made screen of 120 mesh using a 15% vinyl acetate adhesive solution in methanol.

To achieve a method for preparing a thermosensitive stencil according to the present invention, the thus constructed thermal printer A and the cartridge B containing a thermosensitive stencil original are used. Specifically, the cartridge B containing a thermosensitive stencil original 20 is first loaded onto the cartridge compartment 13 of the thermal printer A, the thermal printer A having a thermal head 12 that permits tape-printing. Subsequently, an operator sets up a print image comprising input characters on the thermal printer A by means of the keyboard 10, by using, for example, the selecting dial means, or external input means. The resulting print image can be observed for confirmation through the display portion 11 comprising, for example, a liquid crystal display device. Then, by perforating the thermosensitive stencil original 20, the thermal head 12 prints the print image on the portion of the thermosensitive stencil original 20 that is fed from the aforementioned cartridge B. A thermosensitive stencil of desired length is thereby prepared.

Figure 6:
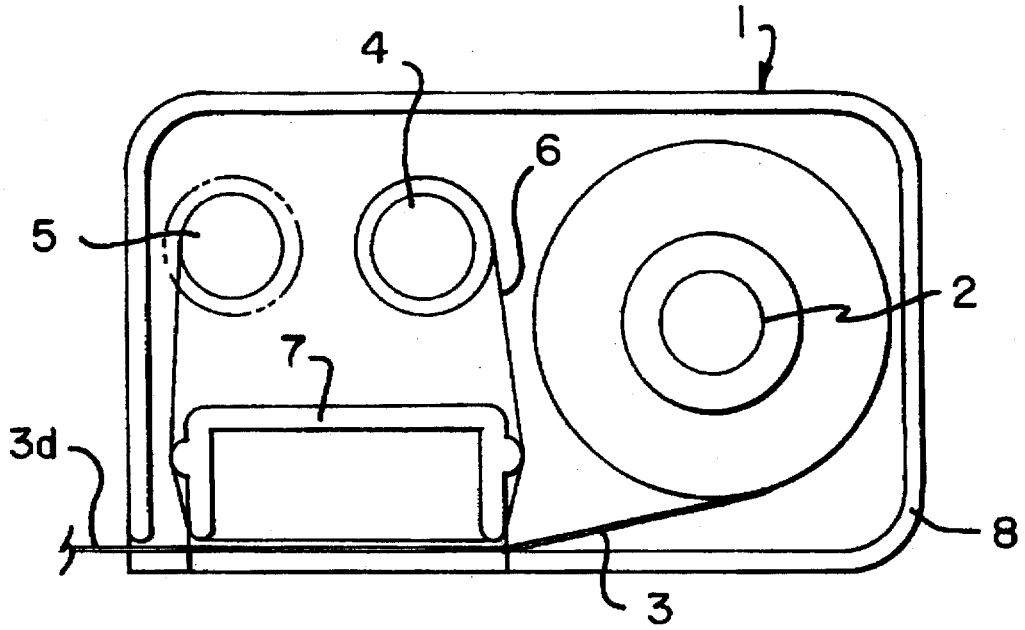
FIG. 6 PRIOR ART
FIG. 6 is a schematic plan view showing an example of a conventional cartridge containing a label tape original.
Figure 7:
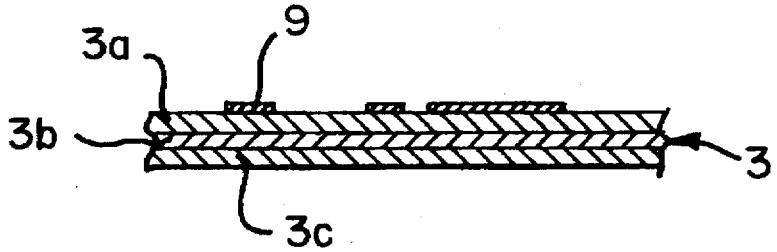
FIG. 7 PRIOR ART
FIG. 7 is a sectional view showing an example of a conventional label tape.

In the preferred embodiment of the present invention, a thermosensitive stencil face 20*a* shown in FIG. 1B is set facing the same side as the printed face 3*d* of the conventional label tape cartridge shown in FIG. 6. Typically, proper or unmirrored images of the input characters are printed on ordinary label tape. By contrast, in the present invention, a mirrored image must be perforated on the thermosensitive stencil original 20. Therefore, the thermal printer A is required to have functions for printing both proper and mirrored print images. The selection of mirrored images may be set up manually. Alternatively, it is possible to provide a sensor device for the stencil cartridge to allow the printer to make the selection automatically.

Thus, according to the method described above, a thermal printer having the features of an existing label word processor can be used to easily create a thermosensitive stencil in a manner similar to that used by existing word processors to prepare tape labels. The thermal printer contains a cartridge identical to a label tape cartridge typically mounted on a thermal printer. The cartridge accommodates a rolled, tape-formed thermosensitive stencil original so that it can be carried out therefrom for the thermal printer. However, the function for setting up mirrored printing must be provided in the printer to function when the label tape cartridge is replaced with the cartridge containing the thermosensitive stencil original. Since the cartridge containing the thermosensitive stencil original can be loaded onto the cartridge compartment of the thermal printer which is capable of tape-printing, the cartridge can readily be handled in the same manner as the conventional label tape cartridge.

Figure 4:
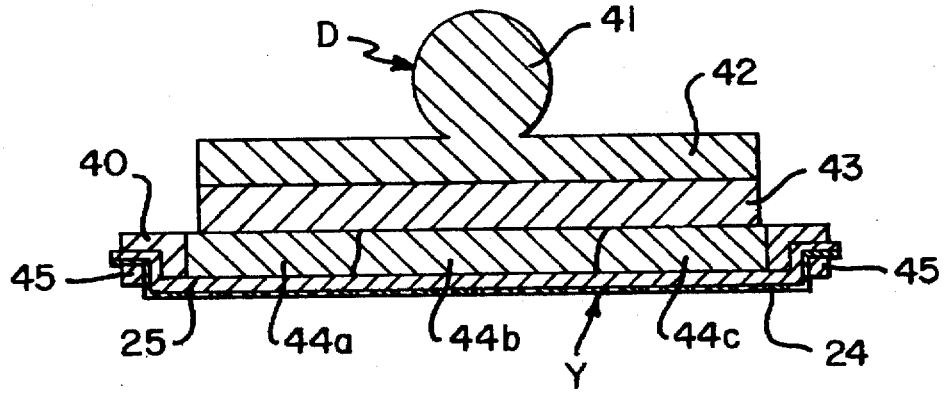
FIG. 4 is a sectional view showing the thermosensitive stencil mounted in alternative fashion to another stamping device.
Figure 5:
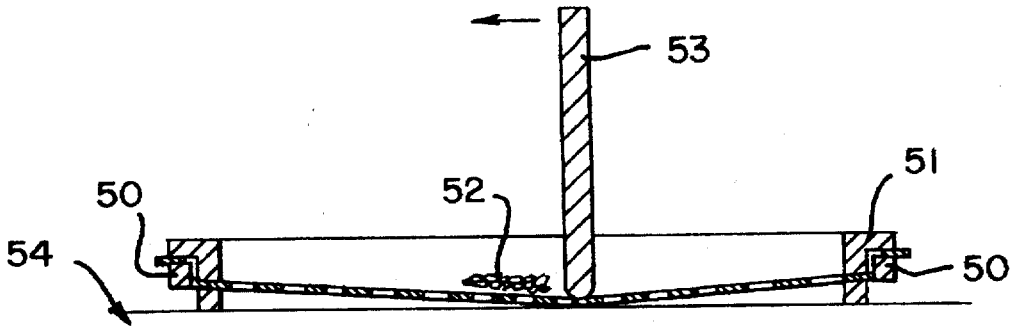
FIG. 5 is a sectional view showing the thermosensitive stencil mounted in alternative fashion to a different stamping device.

FIGS. 3 to 5 show examples of actual uses of the thermosensitive stencil prepared by the method of the present invention and mounted onto a variety of stamping devices and the like.

A stamping device C shown in FIG. 3 includes a holder 30; a pressing member 33 having a handle 31 and an ink supplying hole 32, an ink reserving pad 34, and an ink retaining pad 35, successively disposed underneath the pressing member 33; return springs 36 interposed between the holder 30 and the pressing member 33; and a stencil original holding frame 37. In this arrangement, a thermosensitive stencil Y prepared by the method of the present invention is mounted on the holder 30 by means of the stencil holding frame 37, whereby the stencil Y can be pressed on a sheet of, for example, printing paper.

Another stamping device D illustrated in FIG. 4 has a holder 40, and a pressing member 42, the pressing member 42 having a handle 41 and a cushioning member 43, an ink oozing member 44, and a stencil holding frame 45, successively disposed underneath the pressing member 42. In this arrangement, a thermosensitive stencil Y prepared by the method of the present invention is mounted on the holder 40 by means of the stencil holding frame 45, whereby the stencil Y can be pressed on, for example, a sheet of printing paper.

In operation, the ink oozing member 44 has gel ink layer sections 44*a*, 44*b* and 44*c*, so that various kinds of ink, each having different colors and viscosity, can be used. Therefore, a wider range of uses may be achieved. Particularly, several kinds of gel ink having different colors can be set on the same stencil, thereby making it possible to achieve simultaneous multi-color printing.

FIG. 5 shows a method of ink printing using a squeegee. A thermosensitive stencil Y, prepared by the method of the present invention, is mounted on a holder member 51 by means of a stencil holding frame 50. A squeegee 53 is used to apply ink 52 onto a sheet surface 54 for effecting screen printing. Consequently, it is possible to create bulky printing with an increased amount of ink.

As illustrated above, the thermosensitive stencil prepared by the method of the present invention can easily be mounted onto several different stamping devices, making it possible to employ the thermosensitive stencils in printing methods such as successive stampings.

According to the invention, a stamp can be readily and quickly prepared by loading the cartridge containing the thermosensitive stencil original into a label word processor having a thermal printer. This feature provides a marked advantage because, otherwise, it could take several days to order a prepared stamp from the maker.

Further, the stamp to which the stencil of the invention is applied is less expensive to prepare than a corresponding rubber stamp. Thus, provided that the stamp is not intended for extended use or else is used temporarily, the running cost can be greatly reduced. This advantage is most notable whenever a long stamp is to be prepared.

The only limitation placed upon the structure of the cartridge containing the thermosensitive stencil original is that the cartridge must be capable of being loaded into the cartridge compartment of a thermal printer having a thermal head capable of tape printing. Likewise, the above-described thermal printer must be able to generate the print images designated by an input means on the thermal printer or by an external input means, and be able to create the print images, by means of the thermal head, onto a thermosensitive stencil original delivered out from the aforementioned cartridge, thereby preparing a proper length of a resulting thermosensitive stencil. This is done by perforating the stencil original.

The present invention provides a simplified and assured method for preparing a thermosensitive stencil using a cartridge containing a thermosensitive stencil original. When the thermosensitive stencil original is adapted to be accommodated in a cartridge which can be loaded into a currently marketed label word processor having a thermal printer so that the stencil original can be thermally perforated by the thermal head, it is possible to prepare a thermosensitive stencil having similar patterns as those formed on the label tape. Thus, the resulting thermosensitive stencil can be used for a stamp which preferably allows repeated printings. Further, because an existing label word processor is used, this invention increases the utility of existing label word processors. Moreover, since the thermosensitive stencil original is provided in tape-form, there is practically no length limitation on the stencil original. Thus, the method for preparing the thermosensitive stencil of the present invention, as well as the cartridge containing the thermosensitive stencil original used therefor, may be used to prepare stamps which are longer than any stamps previously envisioned.

While the invention has been particularly shown and described with reference to preferred embodiments thereof, it will be understood by those skilled in the art that various changes in form and details may be made therein without departing from the spirit and scope of the invention.

What is claimed is:

1. A method for preparing a thermosensitive stencil with a label word processor having a label tape cartridge compartment, a thermal printer, and a thermal head, said cartridge compartment being shaped to receive a cartridge containing a label tape therein, and said thermal printer being designed for printing on said label tape with heat generated by said thermal head, said method comprising the steps of:

providing a cartridge having substantially the same shape and features as a label tape cartridge designed for use with said label word processor, said cartridge having a thermosensitive stencil tape therein and containing no thermal transfer ink ribbon such as required in label tape cartridges;

loading said cartridge into said cartridge compartment of said label word processor designed for tape-printing;

perforating said stencil tape to create a print image by means of said thermal head; and cutting a resulting stencil carried out from said cartridge in a desired length.

2. The method for preparing a thermosensitive stencil according to claim 1, wherein the print image is set up by an input means on the thermal printer.

3. The method for preparing a thermosensitive stencil according to claim 1, wherein the print image is set up by an external input means.

4. The method for preparing a thermosensitive stencil according to claim 1, wherein the thermosensitive stencil tape comprises (1) a porous supporting sheet and, (2) a thermoplastic resin film having a thickness of between 3 and 15 μm, adhered to the porous supporting sheet.

5. The method for preparing a thermosensitive stencil according to claim 4, wherein the porous supporting sheet comprises an organic fiber-made screen.

* * * * *